US006168380B1

(12) United States Patent
Weigand

(10) Patent No.: US 6,168,380 B1
(45) Date of Patent: Jan. 2, 2001

(54) COOLING SYSTEM FOR THE LEADING-EDGE REGION OF A HOLLOW GAS-TURBINE BLADE

(75) Inventor: Bernhard Weigand, Waldshut-Tiengen (DE)

(73) Assignee: Asea Brown Boveri AG, Baden (CH)

( * ) Notice: Under 35 U.S.C. 154(b), the term of this patent shall be extended for 0 days.

(21) Appl. No.: 09/111,874

(22) Filed: Jul. 8, 1998

(30) Foreign Application Priority Data

Jul. 15, 1997 (EP) ..... 97810492

(51) Int. Cl.[7] ..... F01D 5/18
(52) U.S. Cl. ..... 416/96 R; 415/115
(58) Field of Search ..... 416/96 R, 96 A, 416/97 R; 415/115, 116

(56) References Cited

U.S. PATENT DOCUMENTS

| | | | | |
|---|---|---|---|---|
| 4,514,144 | * | 4/1985 | Lee | 416/96 R |
| 4,820,122 | * | 4/1989 | Hall et al. | 416/97 R |
| 4,820,123 | | 4/1989 | Hall . | |
| 5,122,033 | | 6/1992 | Paul . | |
| 5,403,159 | * | 4/1995 | Green et al. | 416/97 R |

FOREIGN PATENT DOCUMENTS 2703815 2/1979 (DE) .

WO86/02406 4/1986 (WO) .

OTHER PUBLICATIONS

"Full Surface Local Heat Transfer Coefficient Measurements in a Model of an Integrally Cast Impingement Cooling Geometry", Gillespie, et al., Jun. 10–13, 1996 presentation at the International Gas Turbine and Aeroengine Congress & Exhibition.

* cited by examiner

*Primary Examiner*—Edward K. Look
*Assistant Examiner*—Liam McDowell
(74) *Attorney, Agent, or Firm*—Burns, Doane, Swecker & Mathis, L.L.P.

(57) ABSTRACT

In a cooling system for the leading-edge region of a hollow gas-turbine blade, a duct (10) extends inside the thickened blade leading edge (5) from the blade root (1) up to the blade tip (2). The duct (10), via a plurality of bores (9) made in the blade leading edge, communicates with a main duct (3), through which the cooling medium flows longitudinally, and the flow through the duct (10) occurs longitudinally over the blade height, and the duct (10) is formed with a variable cross section. The cross section of the duct (10) increases continuously in the direction of flow of the cooling medium from the blade root up to the blade tip. In the case of blades having a cover plate (11), the duct (10) merges at its top end into a chamber (12), which is mounted below the cover plate and is in operative connection with a pressure source, the pressure of which is lower than the pressure in the main duct.

6 Claims, 1 Drawing Sheet

FIG. 1
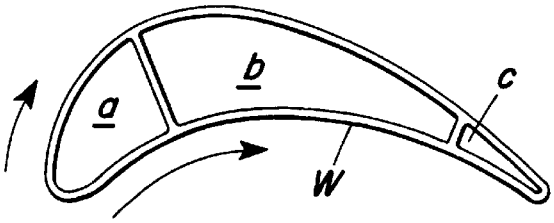
FIG. 2
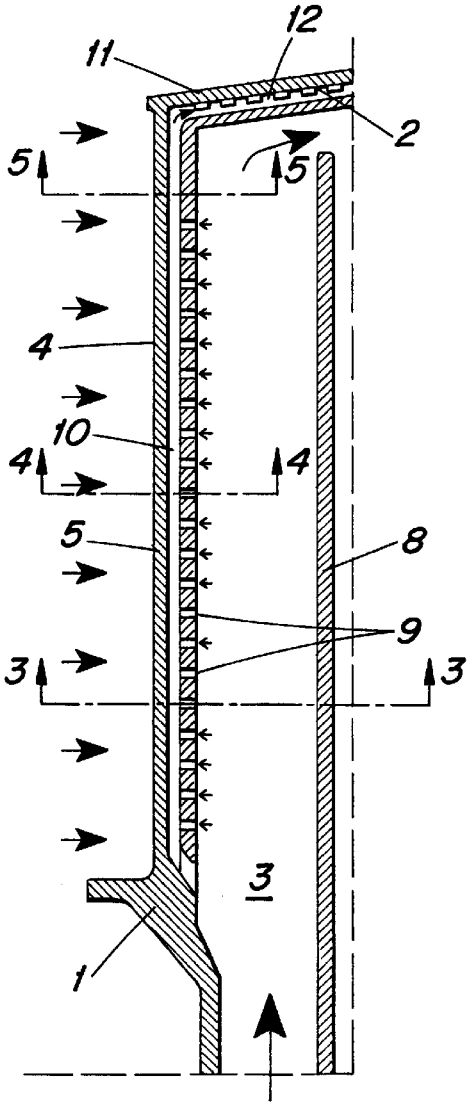
FIG. 3
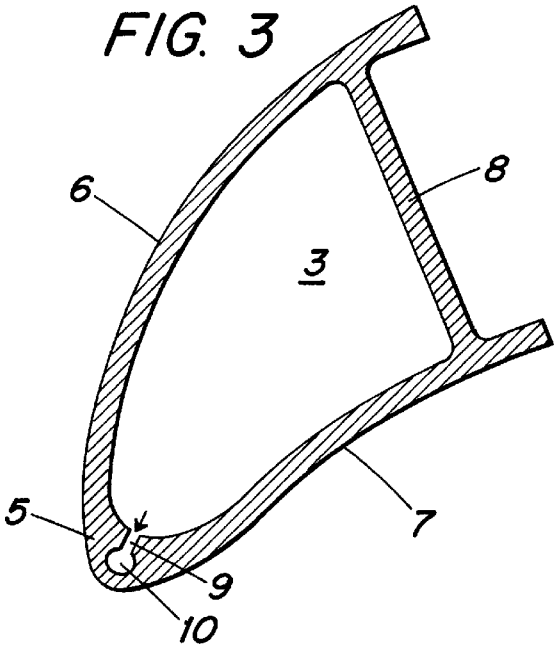
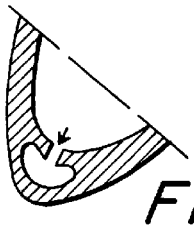
FIG. 4
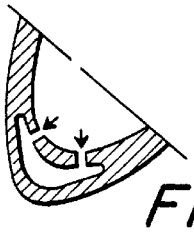
FIG. 5

COOLING SYSTEM FOR THE LEADING-EDGE REGION OF A HOLLOW GAS-TURBINE BLADE

FIELD OF THE INVENTION

The invention relates to a cooling system for the leading-edge region of a hollow gas-turbine blade.

BACKGROUND OF THE INVENTION

Hollow, internally cooled turbine blades with liquid, steam or air as cooling medium are sufficiently known. In particular, the cooling of the leading-edge region of such blades poses a problem.

DE-A1 27 03 815 discloses a cooling system for the leading edge region of a hollow gas turbine blade. The blade used there has a main duct in the leading-edge region, and this main duct is formed by an insert supported on the inner walls of the blade. The leading-edge section is of thicker construction and encloses a cavity. The thickened section is connected to both the blade root and the blade cover plate and serves in particular the torsional rigidity. Via a plurality of bores, the cavity is fed over its height with cooling medium from the main duct, through which flow occurs longitudinally. In this case, the insides of the leading edge in the region of the cavity are impingement-cooled. The cavity is provided at the actual leading edge with through-holes to the outer wall. The cooling medium issuing via the through-holes into the turbine duct thus effects film cooling of the leading-edge region. The bores from the main duct to the cavity are dimensioned in such a way that the pressure drop required for the subsequent film cooling is produced in them.

SUMMARY OF THE INVENTION

Accordingly, one object of the invention is to provide a novel cooling system of the type in which the leading edge is acted upon with pure convection cooling without additional film cooling.

This object is achieved by providing for flow of cooling air through the duct longitudinally over the blade height and the duct is formed with a variable cross section, a means of influencing the coefficient of heat transfer at the leading edge in a desired manner via the selection of the cross section and via the number and dimensioning of the bores is available.

In the case of blades which are provided with a cover plate, it is expedient if the duct merges at its top end into a chamber, which is mounted below the cover plate and is in operative connection with a pressure source, the pressure of which is lower than the pressure in the main duct.

BRIEF DESCRIPTION OF THE DRAWINGS

A more complete appreciation of the invention and many of the attendant advantages thereof will be readily obtained by reference to the following detailed description when considered in connection with the accompanying drawings, wherein:

FIG. 1 is a cross-sectional view of a blade in accordance with this invention;

FIG. 2 is a longitudinal cross-sectional view through the leading-edge region of the blade in FIG. 1;

FIG. 3 is a cross-sectional view of the blade along lines 3—3 in FIG. 1;

FIG. 4 is a cross-sectional view of the blade along the line 4—4 in FIG. 1; and FIG. 5 is a cross-sectional view of the blade along the line 5—5 in FIG. 1, showing the leading edge at the blade tip.

DETAILED DESCRIPTION OF THE INVENTION

Referring now to the drawings, wherein like reference numerals designate identical or corresponding parts throughout the several views, only the elements essential for understanding the invention are shown and the direction of flow of the media involved is designated by arrows, the cast blade shown in FIG. 1 has three inner chambers a, b and c, through which a cooling medium, for example air, flows perpendicularly to the drawing plane. In this case, the cooling medium flows around the insides of the wall W, which forms the blade contour and around which hot gases flow on the outside on either side, the insides of said wall W giving off their heat to the cooling medium. As a rule, numerous aids (not shown here) such as guide ribs, flow ducts, inserts for impingement cooling and the like may be provided, at least in the two leading chambers a, b, in order to improve the wall cooling. In the example of a moving blade provided with a cover plate 11, the cooling medium circulates in several passes through the inner chambers a, b and c and can be drawn off, for example via the blade trailing edge (not shown), into the turbine duct.

In the leading chamber a there is the problem region of the actual leading edge, against which the hot gases flow directly and which therefore requires especially careful cooling.

FIGS. 2 to 5 show the cooling system for the leading-edge region of a hollow gas-turbine blade. A main duct 3, through which flow occurs longitudinally and which corresponds to the chamber a in FIG. 1, extends from the blade root 1 up to the blade tip 2. In the region of the blade body 4, this duct is defined by the inner walls of the leading edge, the suction side 6 and the pressure side 7 as well as by a web 8 connecting the pressure side to the suction side.

A duct 10 extends inside the thickened leading edge 5 of the blade from the blade root up to the blade tip. It goes without saying that this duct, depending on requirements, need not extend right down to the blade root. Its bottom end could also be located slightly further radially outward and could start, for example, just below the midpoint of the blade height, where as a rule the greatest thermal loading occurs.

At the blade tip, the duct 10 merges into a chamber 12, which runs below the cover plate 1. This chamber extends up to the blade trailing edge (not shown), which is open, at least in the chamber region, toward the gas-turbine duct, through which flow occurs. The pressure which prevails at the blade trailing edge and which at any rate is less than the pressure prevailing in the main duct 3, through which flow occurs longitudinally, is therefore effective in the duct 10. This pressure difference results in the medium which is located in the duct 10 flowing off toward the trailing edge.

It goes without saying that the trailing-edge pressure need not necessarily be applied to the duct 10 for this driving pressure difference. Thus, the chamber 12 could also be in operative connection with a vortex chamber, as generally provided in the labyrinths above the cover plate between two cover-plate serrations or sealing strips.

Via a plurality of bores 9 made in the inner region of the leading edge of the blade, the duct 10 communicates with the main duct 3, through which the cooling medium flows longitudinally.—The driving pressure difference ensures that some of the medium flowing along the leading edge in the main duct 3 now flows via these bores 9 into the duct 10 and strikes the duct inner wall there as an impingement jet. More and more cooling air therefore passes into the duct 10 in increasing radial extension. In order to achieve fairly uniform metal temperatures over the height of the blade body, a measure which permits an at least approximately uniform velocity of the outflowing cooling medium in the longitudinal direction of the duct 10 is now taken. To this end, the duct is widened in radial direction.

As can be seen from FIGS. 3, 4 and 5, the cross section, through which flow occurs, from the blade root up to the blade tip becomes increasingly larger, specifically as a function of the new impingement jets being added in each case. Depending on the selected spacing, number and dimensioning of the bores 9, the cross-sectional increase may therefore either be continuous or discontinuous. Decisive for the type of cross-sectional increase is the stipulation that the ratio of the velocity of the respective impingement jet to the velocity of the longitudinal flow in the duct 10 is always to be large. This prevents the outflowing air from impairing the action of the impingement jets.

As can be seen from FIG. 5, a plurality of bores 9 may be provided next to one another in the tip region in the same radial plane in order to exert the impingement action over a wider region of the leading edge.

Tests have shown that, with the novel solution, the coefficient of heat transfer can be up to 10× higher than in a smooth plane reference duct. Compared with the triangular duct a without the novel measure, the coefficient of heat transfer accordingly will be even higher. In certain cases, this circumstance can result in the known film cooling in the leading edge with corresponding fluid loss being dispensed with.

This increased coefficient of heat transfer applies to the actual nose, which is cooled convectively by longitudinal and impingement flow. However, an increased coefficient of heat transfer is also achieved in the rear region of the leading edge owing to the fact that the outflow from the duct 3 into the bores 9 increases the intensity of flow in this region. Compared with the smooth triangular duct a without the novel measure, considerably more cooling medium flows along the duct wall provided with the bores with correspondingly more effective cooling.

In the event of any damage to the leading edge caused by the impingement of foreign bodies, the mode of operation of the main duct 3 is not impaired. In this case, the damaged parts could be film-cooled via the adjoining bores 9.

The inner wall of the cover plate may be ribbed above the chamber 12, the shape of which, for example, corresponds to the profile shape of the blade. With this measure, the outflowing air could also help to cool the cover plate.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A cooling system for the leading edge region of a hollow gas turbine blade, comprising: a turbine blade having a cooling duct inside the blade and extending along the leading edge of the blade from the root to the tip of the blade, the blade also having a main duct extending from adjacent the blade root to a location adjacent the tip of the blade, the leading edge of the blade having a plurality of bores communicating between the cooling duct and the main duct, the cooling duct having a cross-sectional area that increases progressively from adjacent the root to adjacent the tip of the blade, whereby a cooling medium flows from the main duct into the cooling duct through the bores to provide cooling by convection.

2. The cooling system as claimed in claim 1, wherein the main duct is defined directly by the inner walls of the leading edge, the suction side and the pressure side as well as by a web connecting the pressure side to the suction side.

3. The cooling system as claimed in claim 1, in which the blade is provided with a cover plate, wherein the duct merges at its top end into a chamber, which is mounted below the cover plate.

4. The cooling system as claimed in claim 3, wherein the cover plate is ribbed on its side facing the chamber.

5. A hollow gas turbine blade comprising: a turbine blade having a leading edge and a trailing edge and extending from a root portion to a tip portion, a cooling duct extending from the root portion to the tip portion, a chamber in the tip portion of the blade, a main cooling air duct extending from the root portion and the tip portion, a plurality of bores in the leading edge interconnecting the cooling duct and the main cooling air duct, the bores being spaced apart uniformly from each other, the cooling duct having a cross-sectional area that progressively increases from the root portion to the tip portion and communicates with the chamber, the main air duct having an exit passage adjacent the blade tip portion, the exit passage being independent of the chamber.

6. The hollow gas turbine blade as claimed in claim 5, wherein the main cooling air duct includes a web extending between the pressure side and the suction side of the blade, the web at the tip region is spaced from the chamber for directing the flow of cooling air independently of the chamber.

* * * * *